US006971124B2

(12) United States Patent
Pansini

(10) Patent No.: US 6,971,124 B2
(45) Date of Patent: Dec. 6, 2005

(54) POOL CLEANER STORAGE ARRANGEMENT

(76) Inventor: Andrew L Pansini, 200 Golden Gate Ave., Belvedere, CA (US) 94920

( * ) Notice: Subject to any disclaimer, the term of this patent is extended or adjusted under 35 U.S.C. 154(b) by 195 days.

(21) Appl. No.: 10/685,816

(22) Filed: Oct. 14, 2003

(65) Prior Publication Data

US 2005/0076427 A1 Apr. 14, 2005

(51) Int. Cl.[7] ..... E04H 4/00
(52) U.S. Cl. ..... 4/490; 4/496; 4/494
(58) Field of Search ..... 4/490, 496, 494; 134/168 R

(56) References Cited

U.S. PATENT DOCUMENTS 1,637,423 A * 8/1927 Miller ..... 4/490
3,579,657 A * 5/1971 Gurrieri ..... 4/490
4,379,749 A * 4/1983 Roth ..... 4/490
4,939,797 A * 7/1990 Goettl ..... 4/490
5,279,004 A * 1/1994 Walker ..... 4/563.1
5,329,648 A * 7/1994 Davey ..... 4/490
5,352,358 A * 10/1994 Davey ..... 4/496
5,465,433 A * 11/1995 Nolan ..... 4/496
6,817,041 B1 * 11/2004 Evans et al. ..... 4/496

* cited by examiner

*Primary Examiner*—Khoa D. Huynh
(74) *Attorney, Agent, or Firm*—Howard Cohen

(57) ABSTRACT

An improved storage receptacle for an automatic swimming pool cleaning device that incorporates a cleaning head secured to a retractable hose includes a barrier that is selectively operated to block the opening of the storage receptacle and prevent the cleaning head from entering the storage receptacle during use and becoming trapped. The barrier is a rod slidably disposed within a tube adjacent to the receptacle opening, and hydraulic action drives the rod upwardly to block the opening of the storage receptacle.

1 Claim, 2 Drawing Sheets

POOL CLEANER STORAGE ARRANGEMENT

CROSS-REFERENCE TO RELATED APPLICATIONS

Not Applicable.

FEDERALLY SPONSORED RESEARCH

Not applicable.

SEQUENCE LISTING, ETC ON CD

Not applicable.

BACKGROUND OF THE INVENTION

1. Field of the Invention

This invention relates to apparatus for cleaning a swimming pool and, more particularly, to an improved arrangement for storing a pool cleaning device.

2. Description of Related Art

There are known in the prior art various devices for cleaning the water within a swimming pool. In addition to the stationary, plumbed water circulation system that a swimming pool requires, with its pump, filter, and heater, many pools also are equipped with a system for removing floating objects from the surface of the pool. Such objects may include leaves and other tree debris, insects, garden detritus, and the like. The pool filtering system may require a long time to acquire and remove these objects, and they may be objectionable to swimmers in the pool. Although the floating objects may be removed manually using a skimmer mounted on a long pole, many pool owners employ an automated system for maintaining the pool in as clean a state as possible.

One pool cleaning device that is widely popular and successful comprises a floating cleaning head secured at the distal end of a floating flexible hose. The hose supplies pool water under pressure to the cleaning head, and the head creates a Venturi action that attracts floating debris and enables their capture and removal by the cleaning head. The hose is typically mounted on a take-up reel disposed adjacent to the perimeter of the pool, and the cleaning head is stored in a storage cavity or receptacle (hereinafter, "garage") formed in the upper sidewall of the pool and adjacent to the take-up reel. When the hose is deployed and the cleaning head is released onto the surface of the pool water, the cleaning head is driven by jet action of the water passing therethrough to move forward in a random manner about the surface, thereby assuring that all areas of the pool water surface will be cleaned. An exemplary method and apparatus are described in copending U.S. application Ser. No. 10/078,802 filed by the present inventor.

It has been observed that the random movement of the cleaning head often causes it eventually to approach and enter the receptacle that normally stores the cleaning head when it is not in use. Due to the fact that the head typically moves forwardly, it may become lodged in the garage and thereafter be prevented from traversing the water surface. (This shortcoming has also been observed in the operation of swimming pool cleaners that employ a suction head at the end of a hose or tube.) Prior art systems display a need for measures to prevent this occurrence.

BRIEF SUMMARY OF THE INVENTION

The present invention generally comprises an improved storage receptacle for an automatic swimming pool cleaning device that incorporates a cleaning head secured to a retractable hose. The improvement includes a device that is selectively operated to block the opening of the storage receptacle and prevent the cleaning head from entering the storage receptacle and becoming trapped.

The device of the invention includes a vertical tube or pipe placed below the opening of the storage receptacle and oriented generally vertically, with the upper end of the tube opening to the storage receptacle. A rod is slidably disposed within the tube, and gravitally urged to retract into the tube. The tube is connected through a valve to a hydraulic source, such as pressurized water, so that selective activation of the valve supplies pressurized fluid to the tube and drives the rod upwardly to block the opening of the storage receptacle. The valve is generally activated after the cleaning head and attached head have been deployed, whereby the cleaning head is prevented from reentering the receptacle and becoming ensnared. When the valve is closed and fluid pressure is removed, the rod retracts by its own weight to permit the cleaning head and hose to be retracted into the storage receptacle to await future use.

DETAILED DESCRIPTION OF THE INVENTION

The present invention generally comprises an improved storage receptacle for an automatic swimming pool cleaning device that incorporates a cleaning head secured to a retractable hose. Although the invention will be described with reference to a prior art automatic pool cleaner that utilizes pressurized water flow supplied by a connected hose, it may be appreciated that the invention is equally effective in use with vacuum-operated systems.

Figure 1:
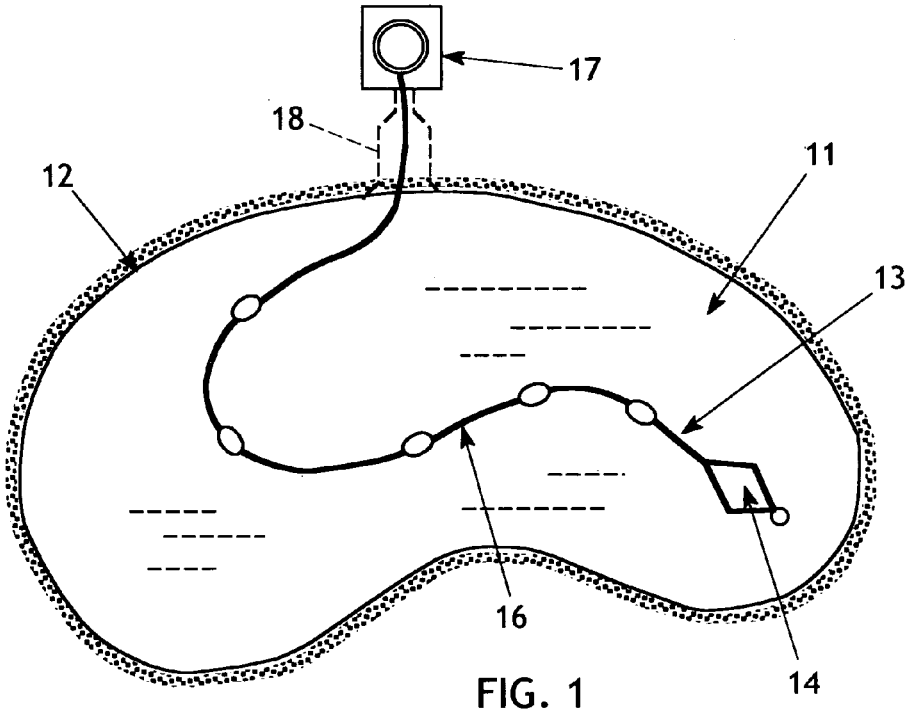
FIG. 1 is a plan view of a typical swimming pool that includes an automatic swimming pool cleaner and the improved pool cleaner storage receptacle of the present invention.

With regard to FIG. 1, a typical swimming pool 11 is defined in part by a sidewall 12. A typical prior art automatic pool cleaner assembly 13 includes a cleaning head 14 attached to a hose 16 that is extendable from a reel assembly 17 disposed adjacent to the sidewall 12. The hose 16 is retractable by the reel assembly 17 to remove the hose from the pool water and draw the cleaning head 14 into a poolside storage receptacle 18 formed in an upper sidewall portion of the pool structure.

One example of an automated reel assembly 17 is described with reference to FIG. 2. The reel assembly 17 includes a hose reel 21 that rotates to deploy or retract the hose 16. The reel 21 may be driven by a water motor 22, comprised of a water wheel 23 driven by a water jet 24 to wind up (retract) the hose 16. The central spindle of the reel 21 is provided with a quick connect swivel fitting 26 that connects to the hose 16 to supply water under pressure to the hose and cleaning head 14. A blow out jet nozzle 27 is provided to discharge into the reel housing.

A salient aspect of the invention is the provision of a vertical tube or pipe 31 placed generally below the opening of the storage receptacle 18 and disposed in or adjacent to the pool sidewall 12. A movable barrier in a form of a rod 32 is received within the pipe 31 with sufficient clearance to be slidably disposed therein and to be moved upwardly by pressurized water applied to the pipe 31. The rod 32 is maintained at rest by its own weight in a retracted position, and is extended by hydraulic means pressurized water supplied to the pipe 31 through supply line 33, which also feeds the quick connect swivel fitting 26.

Figure 2:
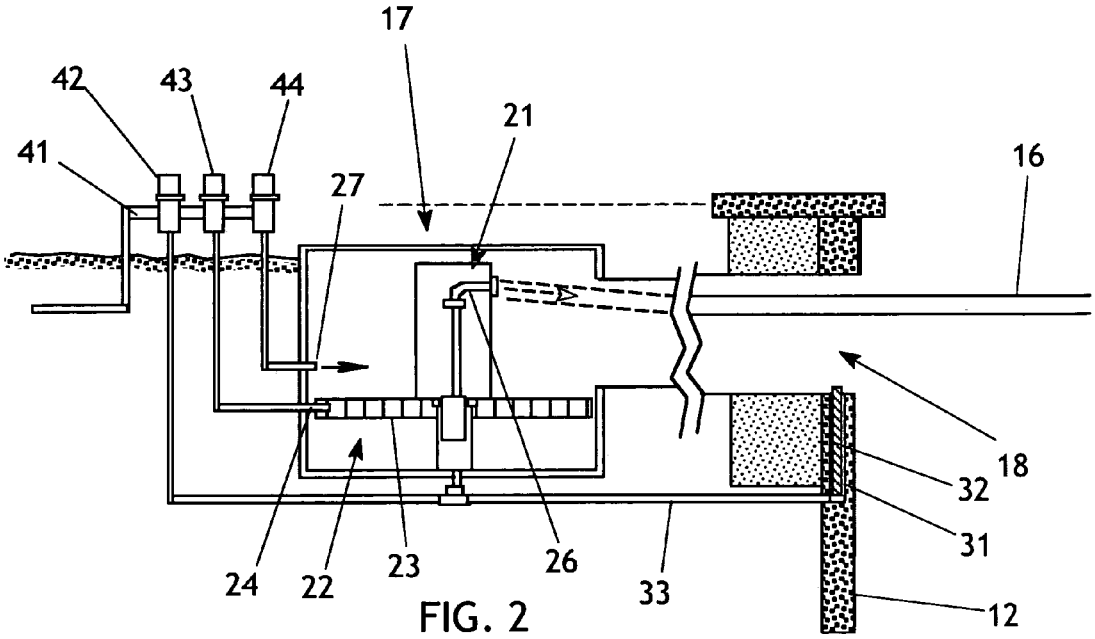
FIG. 2 is a schematic elevation of an exemplary plumbing layout for the improved pool cleaner storage receptacle of the present invention.

An exemplary plumbing layout for the arrangement of FIG. 2 includes a supply header 41 connected to valves 42, 43, and 44. Valve 42 controls flow to supply line 31, valve 43 controls flow to jet 24 to operate the reel, and valve 44 controls flow to the blow out jet nozzle 27. The valves may be operated electrically, as by timer or automated electronic means.

Figure 3:
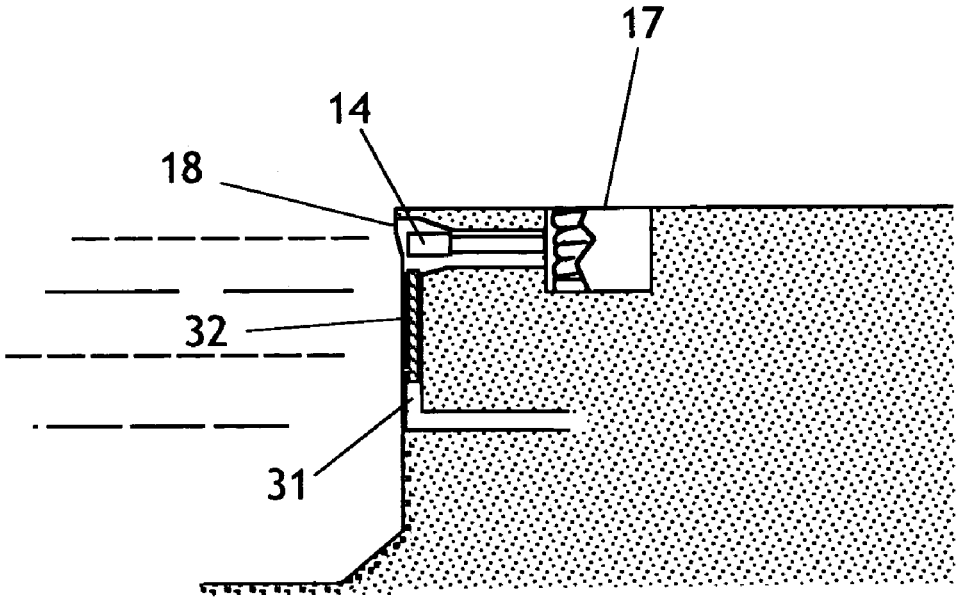
FIG. 3 is a cross-sectional elevation showing the improved pool cleaner storage receptacle of the present invention in the retracted (unactuated) position.
Figure 4:
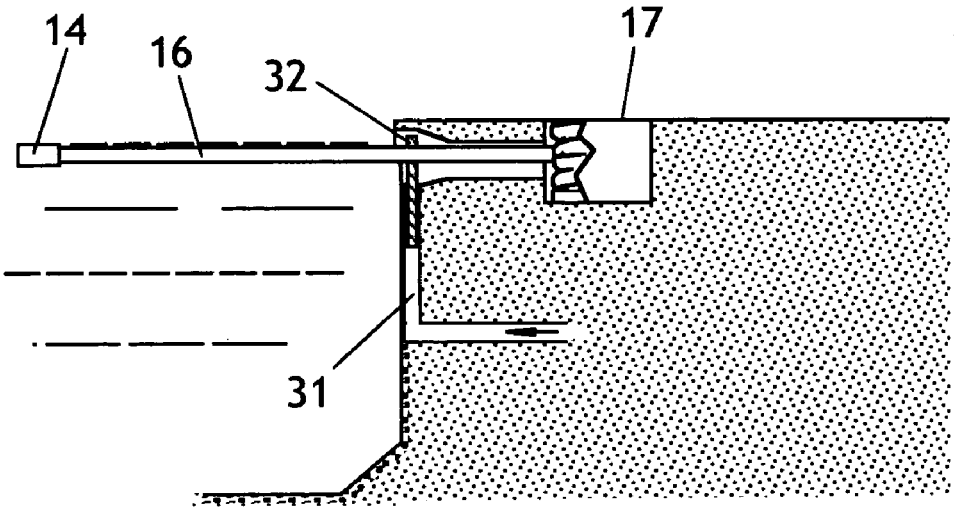
FIG. 4 is a cross-sectional elevation as in FIG. 3, showing the improved pool cleaner storage receptacle of the present invention in the extended (actuated) position.

With regard to FIGS. 2 and 3, the quiescent condition of the valves and mechanisms consists of all valves closed and the rod 32 in the retracted position. To deploy the hose 16 and cleaning head 14, valve 44 is opened to drive blow out jet 27 and drive the hose 16 out of the reel assembly and into the pool 11. Thereafter, valve 44 is closed and valve 42 is opened to supply line 33, which feeds pressurized water to the hose 16 and cleaner head 14 and also drives the rod 32 to "pop up", as shown in FIG. 4, to block the opening to receptacle 18. Note that the rod 32 does not interfere with the hose 16 extending from the receptacle 18. To terminate the pool cleaning cycle, valve 42 is closed, causing the cleaning action to halt and also causing rod 32 to slide downwardly to the retracted position by the weight of the rod. Note that water in the pipe 31 will leak through the clearance as the rod sinks under its own weight to the retracted position. The valve 43 is then actuated to drive the water motor 22 to rotate the reel 21 and take up the hose 16, so that the hose and cleaner head are withdrawn from the surface of the pool.

It may be appreciated that the arrangement of FIGS. 2–4 is only one example of the use of the present invention. The invention may be employed to provide a movable barrier for any pool opening that poses a hazard for any type of pool skimmer or cleaner. Moreover, the movable barrier may be plumbed in other arrangements to suit various pool cleaning and skimming devices.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. In an automatic pool cleaner having a cleaning head stored in a poolside receptacle and deployable to clean the pool water said poolside receptacle having an opening, the improvement comprising:

a movable barrier, said movable barrier including a rod disposed adjacent to said poolside opening, said rod being movable from a first, retracted position in which said opening is substantially unblock to a second, extended position in which said rod substantially block the poolside opening and blocking entry of the deployed cleaning head into said poolside receptacle, wherein said rod is disposed within a pipe, and further including hydraulic means that moves said rod in said pipe from said first, retracted position to said second, extended position when said cleaning head is deployed.

* * * * *